US010110991B2

(12) United States Patent
Crosby et al.

(10) Patent No.: US 10,110,991 B2
(45) Date of Patent: Oct. 23, 2018

(54) ELECTRONIC DEVICE HAVING MECHANICALLY OUT-OF-PHASE SPEAKERS

(71) Applicant: Apple Inc., Cupertino, CA (US)

(72) Inventors: Justin D. Crosby, Cupertino, CA (US); Daniel K. Boothe, San Francisco, CA (US); Houtan R. Farahani, San Ramon, CA (US); Edward T. Sweet, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 28 days.

(21) Appl. No.: 15/203,756

(22) Filed: Jul. 6, 2016

(65) Prior Publication Data

US 2018/0014115 A1 Jan. 11, 2018

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/28*** | (2006.01) |
| ***H04R 1/32*** | (2006.01) |

(52) U.S. Cl.
CPC ..... *H04R 1/2896* (2013.01); *H04R 1/2819* (2013.01); *H04R 1/323* (2013.01)

(58) Field of Classification Search
CPC ..... H01Q 1/2266; H01Q 5/10; H01Q 5/20; H04R 1/2896; H04R 1/2819; H04R 1/323
USPC ..... 343/700 MS; 381/401
See application file for complete search history.

(56) References Cited

U.S. PATENT DOCUMENTS

| | | | | |
|---|---|---|---|---|
| 5,664,020 | A | 9/1997 | Goldfab et al. | |
| 6,628,790 | B1 * | 9/2003 | Klein | H04R 1/225 181/160 |
| 6,985,593 | B2 | 1/2006 | Nichols et al. | |
| 7,062,054 | B2 | 6/2006 | Nishikawa et al. | |
| 9,203,137 | B1 * | 12/2015 | Guterman | H01Q 1/2266 |
| 2006/0002569 | A1 | 1/2006 | Dickie | |
| 2006/0280321 | A1 | 12/2006 | Miura et al. | |
| 2015/0110335 | A1 * | 4/2015 | Telemaque | H04R 9/063 381/400 |
| 2015/0304748 | A1 | 10/2015 | Yamada | |
| 2017/0055069 | A1 * | 2/2017 | Lee | H04R 1/02 |

FOREIGN PATENT DOCUMENTS

| | | |
|---|---|---|
| DE | 2608068 | 9/1977 |

* cited by examiner

*Primary Examiner* — Sean H Nguyen
(74) *Attorney, Agent, or Firm* — Womble Bond Dickinson (US)LLP

(57) ABSTRACT

An electronic device having several speaker modules that are acoustically in-phase and mechanically out-of-phase is disclosed. Embodiments include a pair of speaker modules mounted at respective ends of a lateral link, and the lateral link may be supported relative to a housing of the electronic device. The speaker modules may receive a same audio signal, and the audio signal may drive a first voicecoil in a first direction and a second voicecoil in a second direction. Accordingly, the speaker modules may be driven in mechanically different directions by the same audio signal, such that reactive forces cancel and/or mechanical energy is dissipate in the lateral link between the speaker modules. Other embodiments are also described and claimed.

14 Claims, 8 Drawing Sheets

ELECTRONIC DEVICE HAVING MECHANICALLY OUT-OF-PHASE SPEAKERS

BACKGROUND

Field

Embodiments related to electronic devices having mechanically out-of-phase speaker modules are disclosed. More particularly, embodiments related to portable electronic devices having several voicecoils that are driven in opposite directions by a same audio signal are disclosed.

Background Information

Electronic devices sometimes include a pair of loudspeakers to generate sound from electrical audio signals. Typically, the pair of loudspeakers are located in a common enclosure and are both acoustically and mechanically in-phase. More particularly, the loudspeakers are acoustically in-phase because they generate sound from a same audio signal, and the loudspeakers are mechanically in-phase because the same audio signal drives respective diaphragms of the loudspeakers simultaneously in the same direction.

SUMMARY

Electronic devices having acoustically and mechanically in-phase loudspeakers may experience unintended transmission of forces from the speaker modules into the system housing. In fact, such force transmission may unexpectedly increase as a design consequence of optimizing loudspeaker acoustic output. For example, as loudspeakers are miniaturized, the mass of the loudspeaker moving parts (e.g., a voicecoil) may be increased to achieve a same amount of sound output. The increased diaphragm mass, however, when moved by the voicecoil of the loudspeaker, may apply a greater reactive force to the stationary components of the loudspeaker, e.g., a magnet assembly of the loudspeaker. The reactive force may then be transmitted as a parasitic force into the loudspeaker system as a whole. Consequently, the transmitted reactive force may result in components of the electronic device rattling, creating what is referred to as a "rub and buzz" problem, i.e., increased intermittent contact from other components in the system.

In an embodiment, an electronic device having a display and a manual input device, e.g., a laptop computer, includes mechanically out-of-phase loudspeakers to limit parasitic force transmission. The electronic device may include a housing having a first wall and a second wall opposite of the first wall. The electronic device may include a rigid connector extending in a lateral direction within the housing between a first end and a second end. A first speaker module may be mounted on the rigid connector at the first end, and a second speaker module may be mounted on the rigid connector at the second end. Each speaker module may include a respective voicecoil, and the voicecoils may be mechanically out-of-phase. For example, an electrical current of an audio signal may travel through a first voicecoil of the first speaker module about a first axis in a first direction, and the electrical current may flow through a second voicecoil of the second speaker module about a second axis in a second direction. Thus, the first voicecoil may move along the first axis in the first direction orthogonal to the rigid connector when driven by the audio signal, and the second voicecoil of the second speaker module may move along the second axis in the second direction opposite to the first direction when driven by the audio signal. Accordingly, the first speaker module may radiate sound through the first wall of the housing, and the second speaker module may radiate sound through the second wall of the housing. The reactive forces from the moving voicecoils may be in opposite directions, and thus, a net reactive force may trend toward zero.

The first speaker module of the electronic device may include a first front volume in fluid communication with an enclosure within the housing. The second speaker module may include a second back volume adjacent to the enclosure. For example, the enclosure may be laterally between the first front volume and the second back volume within the housing. In an embodiment, the first front volume and the enclosure have a combined volume equal to the second back volume. Furthermore, the first speaker module may include a first back volume ported through a first slot in the first wall of the housing, and the second speaker module may include a second front volume ported through a second slot in the second wall of the housing. Thus, sound may radiate into a surrounding environment from a front volume of one loudspeaker and from a back volume of another loudspeaker.

In an embodiment, an electronic device, e.g., a laptop computer, includes a housing having a display and a manual input device. The electronic device may include a lever extending laterally between a first end and a second end within the housing. Furthermore, a fulcrum may extend between the housing and the lever, and the fulcrum may be coupled to the lever between the first end and the second end. For example, the fulcrum may be coupled to the lever by a pin joint. Accordingly, a first speaker module may be mounted on the lever on one side of the fulcrum and a second speaker module may be mounted on the lever on another side of the fulcrum. That is, the first speaker module may be mounted on the lever at the first end and the second speaker module may be mounted on the lever at the second end such that a first axis of the first speaker module is laterally offset from a second axis of the second speaker module on opposite sides of the fulcrum. As described above, the first speaker module and the second speaker module may be mechanically out-of-phase such that a first voicecoil of the first speaker module moves along the first axis in a first direction when driven by an audio signal, and a second voicecoil of a second speaker module moves along the second axis in a second direction opposite to the first direction when driven by the audio signal. Thus, reactive forces from the speaker modules may be in opposite directions to cancel and reduce a net reactive force applied to the housing.

The electronic device may include a first gasket between the housing and the first speaker module, and a second gasket between the housing and the second speaker module. The gaskets may be acoustically rigid to provide paths to direct sound from respective speaker modules to a surrounding environment. In addition to being acoustically rigid, the gaskets may be soft. For example, the gaskets may be less stiff than the lever and/or spongy. Thus, the gaskets may absorb and dissipate energy from the moving speaker modules to further reduce a net reactive force applied to the housing by compliant mounting.

The electronic device may include pairs of speaker modules on each side of the fulcrum. For example, a third speaker module may be mounted on the lever at the first end adjacent to the first speaker module. The third speaker module may be mechanically out-of-phase with the first speaker module, i.e., a third voicecoil of the third speaker module may move along a third axis in the second direction when driven by the audio signal. Similarly, a fourth speaker module may be mounted on the lever at the second end adjacent to the second speaker module. The fourth speaker module may be mechanically out-of-phase with the second speaker module, i.e., a fourth voicecoil of the fourth speaker module may move along a fourth axis in the first direction when driven by the audio signal. Thus, a net moment at the joint between the lever and the fulcrum, which is caused by the several reactive forces of the speaker modules, may trend toward zero.

In an embodiment, an electronic device having a housing that includes a display and a manual input device may further include a cantilever extending laterally within the housing from an anchor to a first end. A first speaker module may be mounted on the cantilever at the first end, and the first speaker module may include a first voicecoil. Thus, the first voicecoil may move along a first axis in a first direction orthogonal to the cantilever when driven by an audio signal. The electronic device may further include a second cantilever extending laterally within the housing from a second anchor in an opposite direction of the cantilever to a second end. The second speaker module may be mounted on the second cantilever at the second end, the second speaker module may include a second voicecoil. Thus, the second voicecoil may move along a second axis in a second direction opposite to the first direction when driven by the audio signal. Accordingly, the cantilevers may absorb and dissipate energy from the speaker modules.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
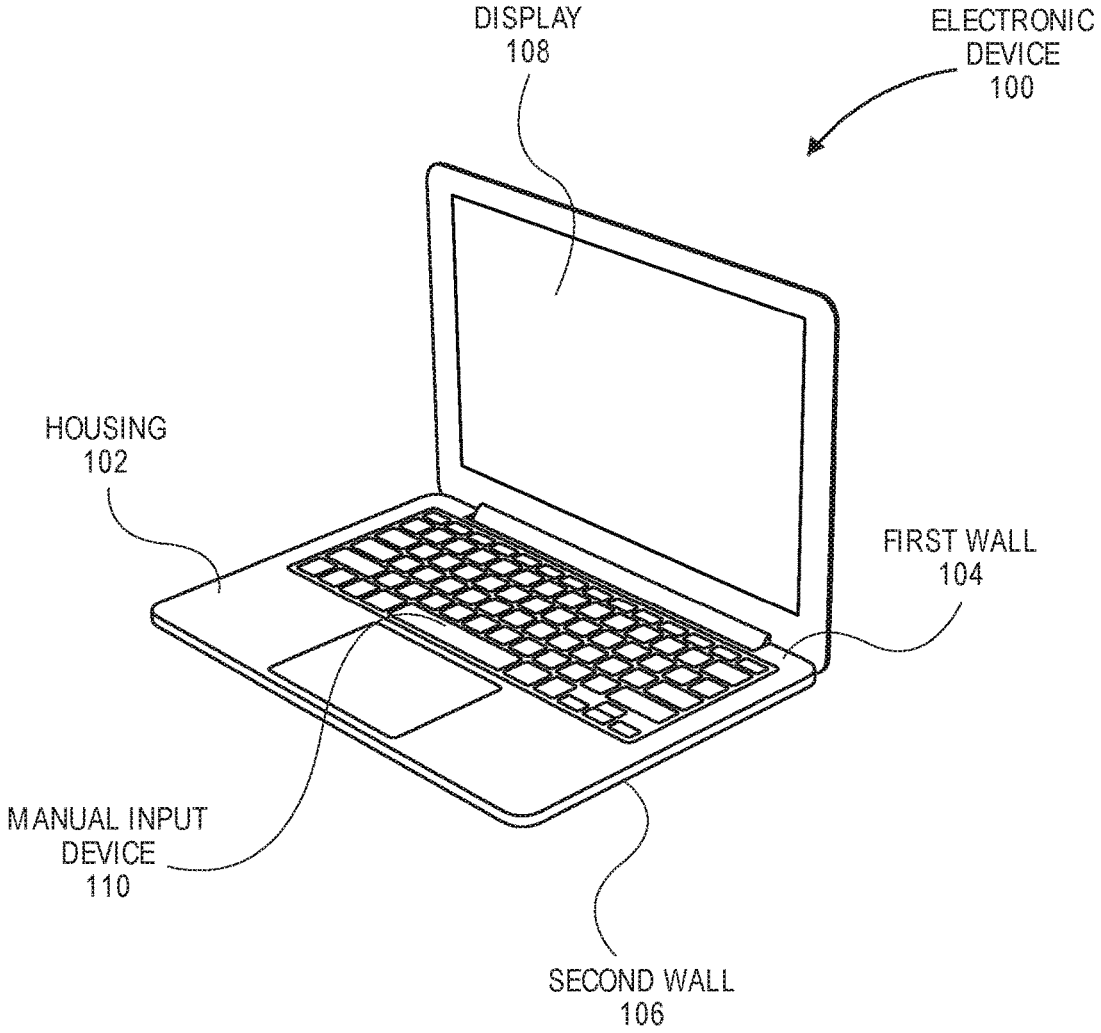
FIG. 1 is a pictorial view of an electronic device in accordance with an embodiment.

Embodiments describe electronic devices having mechanically out-of-phase speaker modules. Some embodiments are described with specific regard to integration within portable electronic devices such as laptop computers. The embodiments are not so limited, however, and certain embodiments may also be applicable to other uses. For example, mechanically out-of-phase speaker modules may be incorporated into other devices and apparatuses, including desktop computers, tablet computers, mobile devices, wearable computers, wristwatch devices, or motor vehicles, to name only a few possible applications.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description, such as "front" and "back" may denote a relative position or direction. For example, a volume on one side of a diaphragm of a speaker module may be described as being a "front volume" and a volume on an opposite side of the diaphragm may be described as being a "back volume." Nonetheless, such terms are not intended to limit the use of the speaker module to a specific configuration described in the various embodiments below.

In an aspect, an electronic device includes mechanically out-of-phase speaker modules. The speaker modules may be laterally separated from each other within a housing of the electronic device, such that an audio signal drives a voicecoil of one speaker module in a first direction orthogonal to a lateral plane and the same audio signal drive a voicecoil of the other speaker module in a second direction opposite of the first direction. The laterally separated speaker modules may radiate sound through opposite walls of the housing, and the speaker modules may be connected by an intervening lateral link. For example, the speaker modules may be mounted at respective ends of a rigid connector, a lever coupled to a fulcrum, or a cantilever. Furthermore, the speaker modules may be allowed to move relative to the housing, e.g., by mounting a soft gasket between the housing and the speaker module, effectively decoupling the linked speaker modules from the housing. Thus, when the speaker modules reproduce sound from the audio signal, parasitically transmitted reactive forces may cancel and/or be dissipated in the intervening link rather than being transmitted into the housing. Accordingly, rub and buzz from the components of the electronic device may be reduced.

Referring to FIG. 1, a pictorial view of an electronic device is shown in accordance with an embodiment. Electronic device 100 may be a portable device, such as a laptop computer. Accordingly, electronic device 100 may include a housing 102 having a first wall 104 and a second wall 106. First wall 104 may be a front, forward, or upward facing wall, and second wall 106 may be a back, rearward, or downward facing wall. More particularly, second wall 106 may be opposite of first wall 104, and first wall 104 and second wall 106 may include respective outward surfaces facing opposite directions. Electronic device 100 may include a display 108 and a manual input device 110 integrated in housing 102. In an embodiment, manual input device 110 includes an alphanumeric input, a touchpad, etc.

Figure 2:
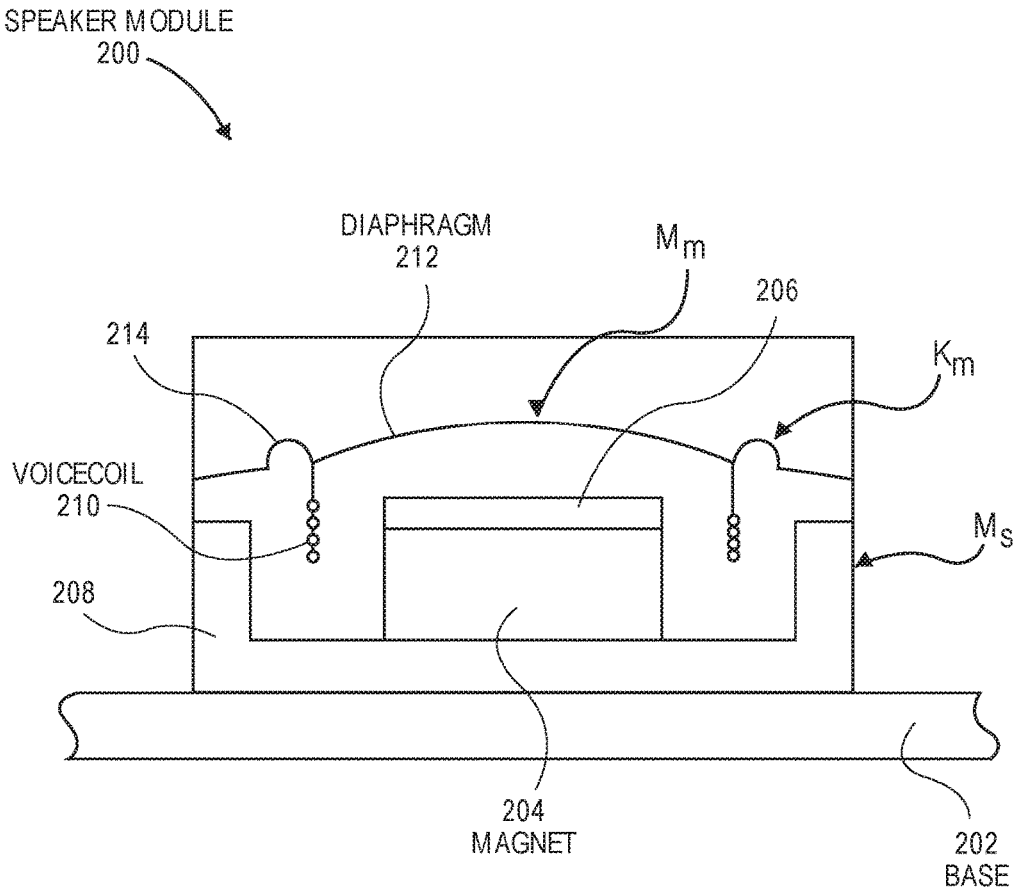
FIG. 2 is a sectional view of a speaker module of an electronic device in accordance with an embodiment.

Referring to FIG. 2, a sectional view of a speaker module of an electronic device is shown in accordance with an embodiment. Electronic device 100 may include one or more speaker modules 200. Speaker modules 200 may be located in a common enclosure, such as within housing 102, and may include a loudspeaker frame mounted on a base 202. For example, base 202 may include an inner surface of first wall 104 or second wall 106 of housing 102 and/or a system component within housing 102, such as a lateral link as described below.

In an embodiment, speaker module 200 includes a motor assembly having moving and stationary parts. A stationary portion of the motor assembly may include magnetic parts such as a magnet 204, a top plate 206, and a yoke 208. The magnetic parts form a magnetic circuit through an intervening gap, e.g., laterally between top plate 206 and yoke 208. A moving portion may include a voicecoil 210 suspended within the gap such that an electrical current flowing through the voicecoil 210 generates a Lorentz force to displace the moving portion relative to the stationary portion of the motor assembly. More particularly, voicecoil 210 may be attached to a diaphragm 212, and diaphragm 212 may be suspended relative to the stationary portion by a surround 214, such that the Lorentz force moves the diaphragm 212 relative to the stationary portion to generate sound.

The stationary portion of speaker module 200 includes the magnet assembly of the motor assembly as well as other stationary parts attached to speaker module 200. Accordingly, the stationary portion of speaker module 200 is associated with a combined mass, $M_s$. Similarly, the moving portion of speaker module 200 having voicecoil 210 and diaphragm 212 is associated with a combined mass, $M_m$. These component masses are coupled by surround 214 having a spring coefficient, $K_m$. Accordingly, when the moving portion is driven to generate sound, a reactive force is transmitted through surround 214 to the stationary portion and into base 202. This parasitic reactive force may then be transmitted through base 202 into housing 102 and/or other components of electronic device 100 that are coupled to base 202. Furthermore, the parasitic force may be multiplied when several speaker modules 200 are attached to base 202 and driven mechanically in-phase.

It is considered that the parasitic force from several speaker modules 200 may be modulated by placing the drivers acoustically in-phase and mechanically out-of-phase. For example, a pair of speaker modules 200 attached to base 202 may be physically flipped relative to one another, or their respective voicecoil 210 windings may be wound in opposite directions, such that the drivers move in different directions when driven by a same audio signal. Accordingly, the drivers may be acoustically in-phase because they generate the same sound from the same audio signal, and the drivers may be mechanically out-of-phase because their diaphragms 212 move and displace mechanical pressure in opposite directions, e.g., upward versus downward. As a result, a reactive force transmitted to base 202 from a first speaker may be upward when the corresponding diaphragm 212 is driven downward, and a reactive force transmitted to base 202 from a second speaker may be downward when the corresponding diaphragm 212 is simultaneously driven upward. That is, the respective reactive forces from each speaker module 200 may act on base 202 in different directions such that a net reactive force on base 202 is reduced. Given that base 202 may not be perfectly rigid, however, and given that the axes of motion of the speaker modules 200 may be separated from each other by a distance, an acoustically in-phase and mechanically out-of-phase speaker module assembly may not experience pure force cancellation. For example, a moment may be transmitted to base 202 by laterally separated speaker modules 200. Thus, parasitic force transmission from an acoustically in-phase and mechanically out-of-phase speaker module 200 assembly may be further optimized.

Figure 3:
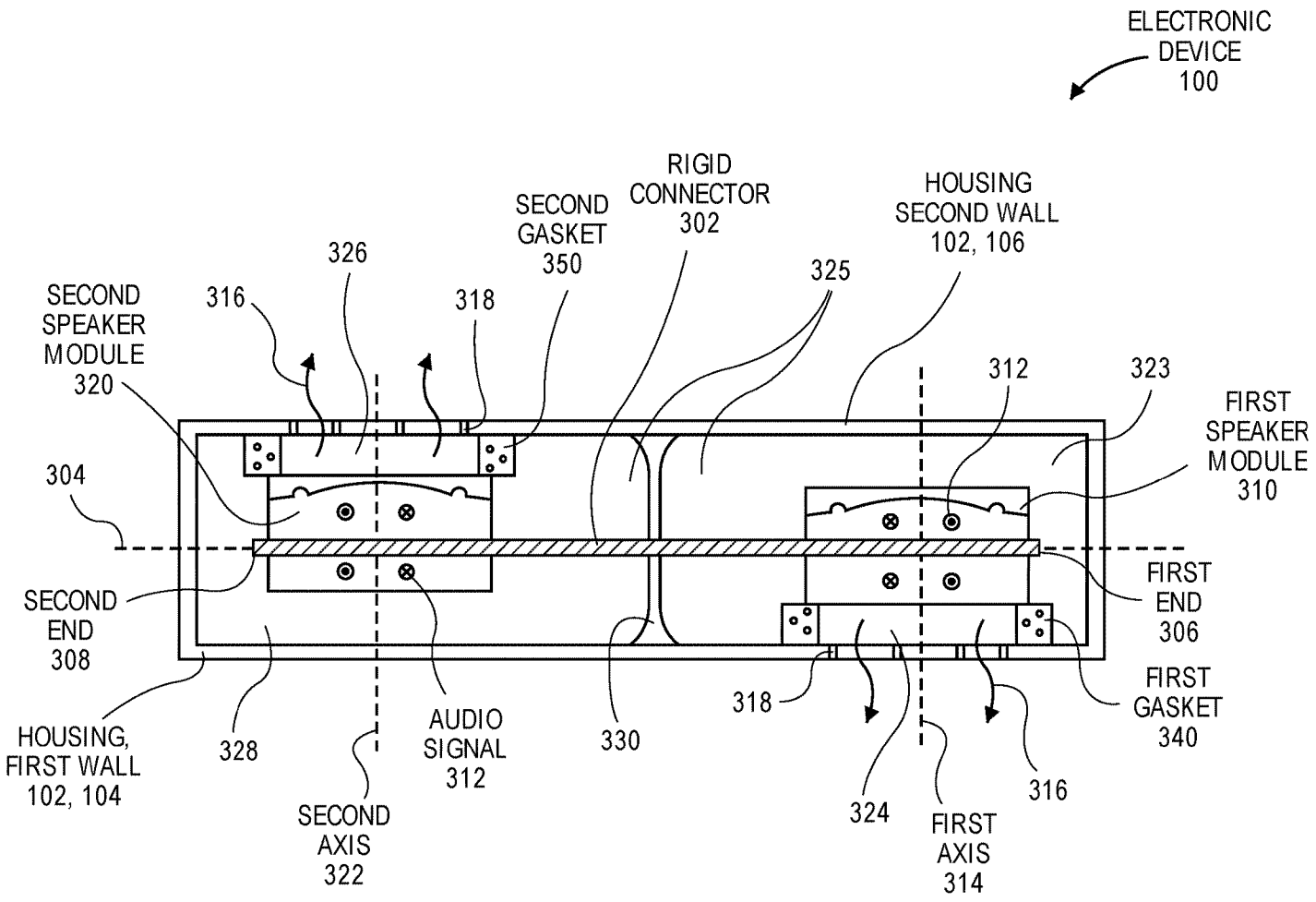
FIG. 3 is a sectional view of an electronic device having speaker modules mounted on a rigid connector in accordance with an embodiment.

Referring to FIG. 3, a sectional view of an electronic device having speaker modules mounted on a rigid connector is shown in accordance with an embodiment. Electronic device 100 may include a pair of speaker modules 200 mounted on a lateral link, e.g., a rigid connector 302, within housing 102. For example, rigid connector 302 may extend in a lateral direction, e.g., along a lateral plane 304, between a first end 306 or edge and a second end 308 or edge. Accordingly, rigid connector 302 may have a profile of a beam or elongated member with first end 306 and second end 308, or alternatively, rigid connector 302 may have a profile of a plate or flat member with a first edge and second edge. More particularly, rigid connector 302 may include laterally separated mounting locations for attaching a pair of speaker modules 200 at separate locations along lateral plane 304. Thus, speaker modules 200 mounted on rigid connector 302 may include respective voicecoils 210 that oscillate on respective axes that are non-coaxial, e.g., laterally offset from one another.

The relative orientation of speaker modules 200 may further be defined with respect to a relative orientation between the axes and the diaphragms 212 of the modules. For example, the respective axes of the speaker modules 200 may be parallel to each other. Similarly, a plane of the respective diaphragms 212 of the speaker modules 200 may be parallel to each other. In an embodiment, the diaphragms 212 define planes that are coplanar, i.e., the diaphragms 212 are arranged at a same axial location relative to their axes of motion, albeit at laterally separated locations along the same plane.

A rigidity of rigid connector 302 may be qualitatively defined. For example, rigid connector 302 may be formed from a material having a stiffness greater than a stiffness of a material forming housing 102. Accordingly, rigid connector 302 may be less susceptible than housing 102 to bending from a moment generated by reactive forces of speaker modules 200.

In an embodiment, electronic device 100 includes a first speaker module 310 mounted on rigid connector 302 at first end 306. First speaker module 310 may have a construction such as that described above, e.g., may include a corresponding voicecoil 210. As indicated by the electrical flux markers in FIG. 3, an audio signal 312, which may be an electrical current, may travel through voicecoil 210 of first speaker module 310 about a first axis 314 in a first direction. That is, voicecoil 210 of first speaker module 310 is illustrated having a right-handed rotational direction around first axis 314 such that the first direction is upward along first axis 314. Furthermore, first axis 314 may be orthogonal to the lateral direction of lateral plane 304 along which rigid connector 302 extends. Accordingly, when driven by audio signal 312, voicecoil 210 of first speaker module 310 may move along first axis 314 in the first direction to radiate a sound 316, e.g., downward, through one or more slots 318 in first wall 104 of housing 102. A thickness of the walls of housing 102 having slots 318 used for sound radiation may be limited to a predetermined range. For example, a thickness of the slotted first wall 104 region may be less than 2 mm. A concomitant reactive force may be transmitted through first speaker module 310 upward and orthogonal to rigid connector 302.

Note that first wall 104 of housing 102 is illustrated as being below first speaker module 310 in FIG. 3, as opposed to being above speaker module 200 as shown in FIG. 1. This permutation clarifies that the directionality associated with speaker modules 200 of electronic device 100 is described by way of example and not limitation. That is, the relative orientations, and the absolute orientations, are of the essence of this description.

Electronic device 100 may include a second speaker module 320 mounted on rigid connector 302 at second end 308. Second speaker module 320 may be acoustically in-phase and mechanically out-of-phase with first speaker module 310. For example, as indicated by the electrical flux markers in FIG. 3, electrical current of audio signal 312 may be reversed through second speaker module 320 to travel through a corresponding voicecoil 210 of second speaker module 320 about a second axis 322 in a second direction. The second direction of second speaker module 320 may be opposite to the first direction of first speaker module 310 described above. That is, voicecoil 210 of second speaker module 320 may have a right-handed rotational direction around a second axis 322 such that the second direction is downward along second axis 322. Furthermore, second axis 322 may be orthogonal to the lateral direction of lateral plane 304. Accordingly, when driven by audio signal 312, voicecoil 210 of second speaker module 320 may move along second axis 322 in the second direction to radiate sound 316 upward through one or more slots 318 in second wall 106 of housing 102.

It will be appreciated that speaker modules 200 having respective voicecoils 210 around parallel and laterally separated axes may also be driven mechanically out-of-phase by reversing a coil direction of their respective voicecoils 210. For example, rather than reversing the signals to travel in opposite directions along the axes, as described above, a voicecoil 210 of first speaker module 310 may be wound around first axis 314 in a right-handed direction, and a voicecoil 210 of second speaker module 320 may be wound around second axis 322 in a left-handed direction. Thus, an electrical signal passing through the respective voicecoils 210 in a same axial direction, e.g., upward, may react with corresponding magnet assemblies of the speaker modules to generate opposing voicecoil 210 and diaphragm 212 movements.

Speaker modules 200 having respective voicecoils 210 around parallel and laterally separated axes may also be driven mechanically out-of-phase by reversing the magnetic system associated with each voicecoil to alter a phase of the speaker module. For example, respective voicecoils 210 may both have a same rotational direction, e.g., right-handed, around a respective axis, but a magnetic flux through the respective magnetic systems may be reversed. That is, a magnetic flux through a center magnet located coaxially with a first voicecoil may be upward, i.e., a north pole of the center magnet may be above a south pole of the center magnet, and a magnetic flux through a center magnet located coaxially with a second voicecoil may be downward. Accordingly, an electrical signal passing through the respective voicecoils in a same direction, e.g., upward and in a right-handed rotational direction, may generate movement of the first voicecoil in a first direction and may generate movement of the second voicecoil in a second direction opposite to the first direction. Accordingly, flipping the magnetic system may generate acoustically in-phase and mechanically out-of-phase motion of a pair of speaker modules 200.

Rigid connector 302 may be mounted within housing 102, as shown in FIG. 3, or alternatively, rigid connector 302 may be incorporated in housing 102. For example, rigid connector 302 may be a portion of first wall 104 or second wall 106 upon which first speaker module 310 and second speaker module 320 are mounted. The portion of housing 102 defining rigid connector 302 may be more rigid than surrounding portions of housing 102. For example, rigid connector 302 may be a metal or glass-filled polymer insert embedded within the housing 102 wall. Accordingly, rigid connector 302 may limit reactive forces transmitted from speaker modules 200 to housing 102 even when rigid connector 302 forms a portion of housing 102.

Rigid connector 302 may be supported relative to housing 102 at first end 306 and/or second end 308. For example, electronic device 100 may include a first gasket 340 between housing 102 and first speaker module 310 and a second gasket 350 between housing 102 and second speaker module 320. In an embodiment, each gasket is formed from a material that is acoustically opaque and softer than the material used to form rigid connector 302. For example, first gasket 340 or second gasket 350 may include a polyurethane foam ring having a central passage to direct sound 316 from respective speaker modules 200 through slots 318 in the housing walls to a surrounding environment outside of housing 102. Electronic device 100 may also include one or more spacers, e.g., grommets, formed from a material softer than the material used to form rigid connector 302, and the spacers may be located between speaker modules 200 and housing 102. Accordingly, rigid connector 302 may be supported relative to housing 102 by one or more soft links that allow speaker modules 200 to move along respective axes orthogonal to lateral plane 304 while remaining constrained relative to each other by rigid connector 302. In essence, the speaker module 200 assembly described above may decouple speaker modules 200 from housing 102 to reduce excitation of system Eigen modes that can worsen rub and buzz of the system.

In an embodiment, first speaker module 310 and second speaker module 320 may be oriented similarly. For example, both speaker modules 200 may have a front volume above diaphragm 212 of the speaker module 200. In the embodiment illustrated in FIG. 3, a first front volume 323 of first speaker module 310 may be within a common back volume 325 of the speaker modules 200. That is, sound 316 may be emitted outward through housing 102 from a first back volume 324 of first speaker module 310, and sound 316 may be transmitted into the enclosed volume within housing 102 from first front volume 323 of first speaker module 310. By contrast, a second front volume 326 of second speaker module 320 may be directed toward the surrounding environment and a second back volume 328 of second speaker module 320 may be within the common back volume 325 of the speaker modules 200. Thus, sound 316 may be emitted outward through housing 102 from second front volume 326 of second speaker module 320, and sound 316 may be transmitted into the enclosed volume within housing 102 from second back volume 328 of second speaker module 320.

In an embodiment, first front volume 323 defines a portion of common back volume 325 and second back volume 328 defines another portion of common back volume 325. Furthermore, the defined portions of common back volume 325 may be acoustically separated from each other by one or more partitions 330. For example, a partition 330 may extend across common back volume 325 within housing 102 to acoustically isolate first speaker module 310 from second speaker module 320. That is, first front volume 323 may be located on one side of partition 330 and second back volume 328 may be located on another side of partition 330. Partition 330 may be located such that first front volume 323 and second back volume 328 occupy equal spatial volumes. As described below, however, first front volume 323 and second back volume 328 may have different sizes.

Figure 4:
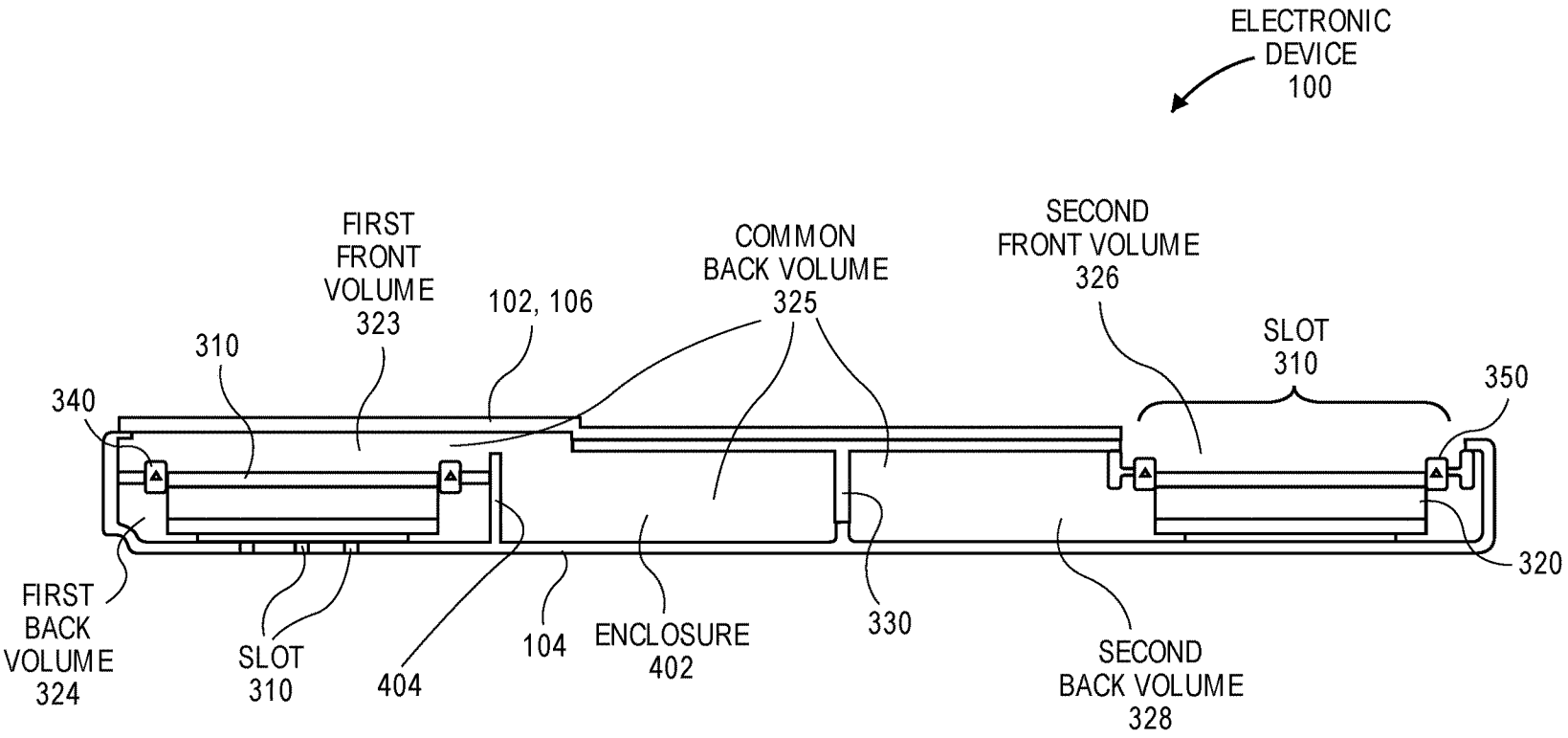
FIG. 4 is a sectional view of an electronic device having a ported front volume of a speaker module in accordance with an embodiment.

Referring to FIG. 4, a sectional view of an electronic device having a ported front volume of a speaker module is shown in accordance with an embodiment. Electronic device 100 may include first speaker module 310 and second speaker module 320 configured essentially as described above. For example, first speaker module 310 may include first back volume 324 separated from first front volume 323 by first gasket 340 such that sound 316 generated by diaphragm 212 of first speaker module 310 is directed through first back volume 324. More particularly, first back volume 324 may be ported through one or more slots 318 in first wall 104 of housing 102 outward into a surrounding environment. Similarly, second speaker module 320 may include second front volume 326 separated from second back volume 328 by second gasket 350 such that sound 316 generated by diaphragm 212 of second speaker module 320 is directed through second front volume 326. More particularly, second front volume 326 may be ported through a slot 318 in second wall 106 of housing 102 outward into the surrounding environment.

A laterally extending link connecting first speaker module 310 to second speaker module 320 may be present within housing 102. Such a link, however, is not shown in FIG. 4 to ease an understanding of the concept being illustrated. More particularly, FIG. 4 illustrates an embodiment of a partitioned common back volume 325 within housing 102 that may be used in combination with a speaker module lateral link as described herein.

In an embodiment, first front volume 323 of first speaker module 310 is placed in fluid communication with an enclosure 402 within housing 102. For example, first front volume 323 may be located in a space between first speaker module 310 and second wall 106 of housing 102, and enclosure 402 may be laterally offset from first front volume 323 to occupy a space between second wall 106 and first wall 104 of housing 102. More particularly, enclosure 402 may be laterally between first front volume 323 and second back volume 328 within housing 102. Thus, sound 316 generated by first speaker module 310 may be ported laterally around a sub-partition 330 into enclosure 402 on one side of partition 330, and sound 316 generated by second speaker module 320 may radiate into second back volume 328 on another side of partition 330. Sound 316 may be ported from first front volume 323 into a volume contained by enclosure 402 through a port in sub-partition 404.

In an embodiment, a combined spatial volume occupied by first front volume 323 and enclosure 402 may be equal to a spatial volume occupied by second back volume 328. That is, common back volume 325 within housing 102 may be equally apportioned between first speaker module 310 and second speaker module 320. Apportionment of common back volume 325 may not be necessary, however, and in some embodiments, there may be no partition 330 or separation between first front volume 323 and second back volume 328 within housing 102.

Embodiments of electronic device 100 described below have a lateral link between speaker modules 200 similar to rigid connector 302. In some embodiments, however, the lateral link may not be perfectly rigid, and thus, parasitic reactive forces may be transmitted through the lateral link. Certain structural configurations of the lateral link may be employed to dissipate such reactive forces and limit the transmission of parasitic forces into housing 102.

Figure 5:
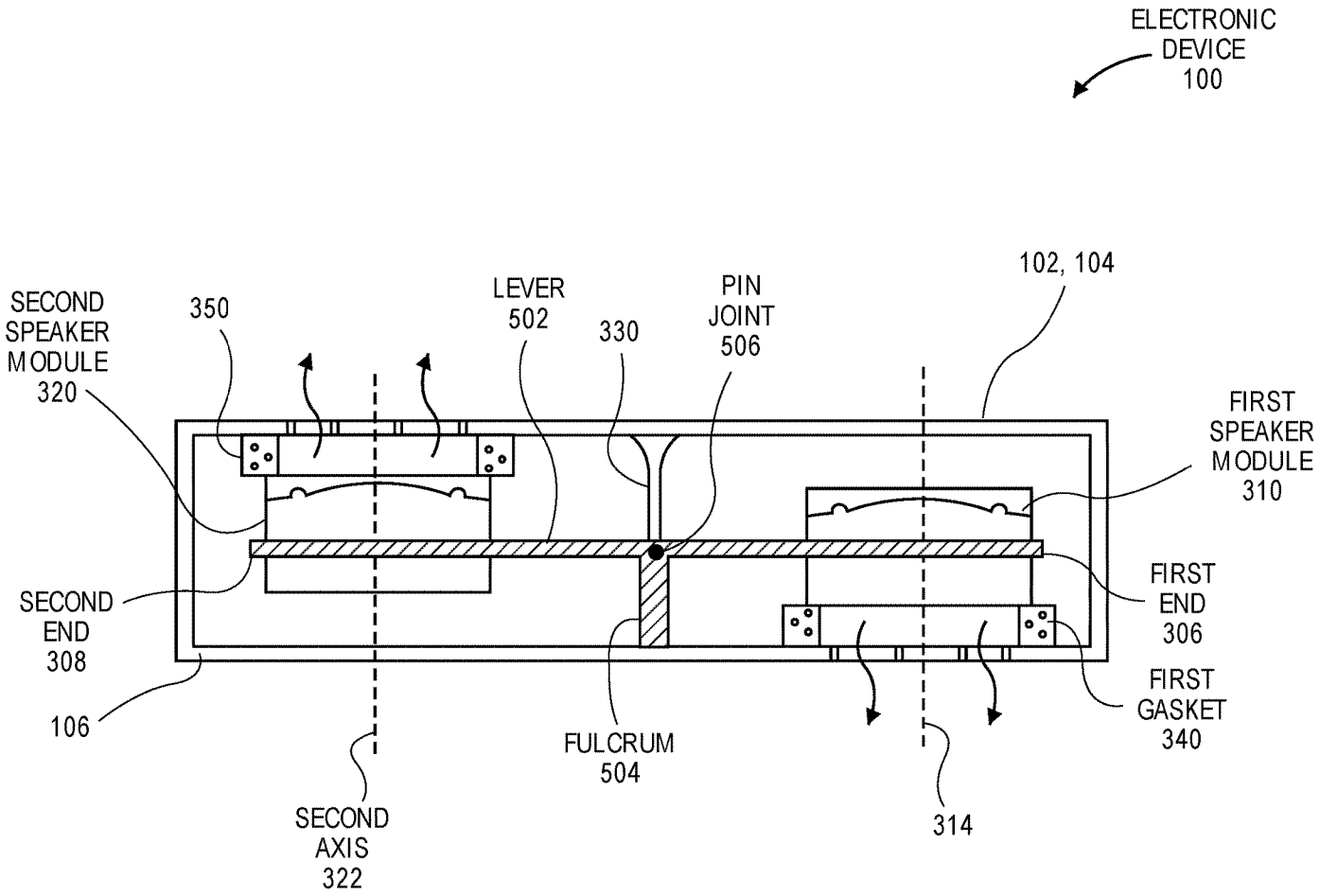
FIG. 5 is a sectional view of an electronic device having speaker modules mounted on a lever in accordance with an embodiment.

Referring to FIG. 5, a sectional view of an electronic device having speaker modules mounted on a lever is shown in accordance with an embodiment. Electronic device 100 may include housing 102 having display 108 and manual input device 110. In an embodiment, a lateral link supporting several speaker modules 200 of electronic device 100 may include a lever 502 extending laterally between first end 306 and second end 308. More particularly, lever 502 may include an elongated member or a flat member extending laterally within housing 102 between opposing ends or edges. First speaker module 310 may be mounted on lever 502, e.g., near first end 306. Accordingly, a respective voicecoil 210 of first speaker module 310 may move along first axis 314 in a first direction when driven by an audio signal 312. Similarly, second speaker module 320 may be mounted on lever 502, e.g., near second end 308. Accordingly, a respective voicecoil 210 of second speaker module 320 may move along second axis 322 in a second direction opposite to first direction when driven by the same audio signal 312 driving first speaker module 310. Accordingly, first speaker module 310 and second speaker module 320 mounted on lever 502 may be mechanically out-of-phase because a positive current applied to a positive lead of first speaker module 310 produces motion in the first direction, and the positive current applied to a positive lead of second speaker module 320 produces motion in the second direction.

Lever 502 of electronic device 100 may be attached to a fulcrum 504. More particularly, fulcrum 504 may extend between housing 102, e.g., second wall 106 of housing 102, and lever 502. Similarly, fulcrum 504 may extend between lever 502 and first wall 104 of housing 102. Fulcrum 504 may have a post structure, e.g., an elongated columnar structure, or fulcrum 504 may have a wall structure, e.g., fulcrum 504 may form a portion of partition 330 within common back volume 325 of housing 102.

In an embodiment, fulcrum 504 is attached to lever 502 between first end 306 and second end 308. For example, first speaker module 310 may be mounted on lever 502 at the first end 306 and second speaker module 320 may be mounted on lever 502 at the second end 308. Thus, second axis 322 may be laterally offset from first axis 314 on opposite sides of fulcrum 504. When respective voicecoils 210 of first speaker module 310 and second speaker module 320 move in opposite directions, opposing reactive forces may be transmitted to lever 502. Thus, lever 502 may pivot about an end of fulcrum 504. Such pivoting may dissipate energy within lever 502 and/or fulcrum 504, rather than transmit the energy into housing 102. In essence, motion of the speaker modules 200 may be decoupled from housing 102 as lever 502 pivots in a seesaw action about fulcrum 504.

In an embodiment, first speaker module 310 and second speaker module 320 may be laterally separated from fulcrum 504 by equal lengths. For example, a distance between a vertical axis running through fulcrum 504 and both first axis 314 and second axis 322 may be equal. Accordingly, a reactive moment at a joint between lever 502 and fulcrum 504 caused by a reactive force of first speaker module 310 may have a same magnitude as a reactive moment at the joint caused by a reactive force of second speaker module 320. In some embodiments, the lateral distances between fulcrum 504 and the speaker module 200 axes may differ.

A joint between lever 502 and fulcrum 504 may constrain relative movement between lever 502 and fulcrum 504 about one or more planes or axes. For example, lever 502 and fulcrum 504 may be integrally formed such that pivoting of lever 502 about fulcrum 504 occurs mainly through material strain at the joint. That is, when the joint is a simply supported fixed support, movement between lever 502 and fulcrum 504 at the joint may be fixed in all translational directions and rotational directions. In an embodiment, however, the joint between lever 502 and fulcrum 504 includes a pin joint 506. By way of example, pin joint 506 may include a pin inserted in respective holes of lever 502 and fulcrum 504, such as may be used in a seesaw structure. Pin joint 506 may allow rotation between lever 502 and fulcrum 504 about an axis of the pin, but may fix lever 502 relative to fulcrum 504 in all translational directions.

Electronic device 100 may include energy absorbing elements between speaker modules 200 and housing 102. For example, first gasket 340 may be located between first speaker module 310 and housing 102. Similarly, second gasket 350 may be located between housing 102 and second speaker module 320. As described above, the gaskets may provide acoustically opaque pads to direct sound 316 from respective speaker modules 200 to a surrounding environment. The gaskets may also absorb mechanical energy from the speaker modules 200 as they move along their respective axes. For example, the gaskets may be softer, i.e., less stiff than, lever 502, and thus, the gaskets may provide soft end boundary conditions for the speaker module assembly. In an embodiment, the gaskets are spongy. For example, first gasket 340 or second gasket 350 may include a foam material. Alternatively, gaskets may include a rubber material or another elastomeric material that resiliently compresses when squeezed between a speaker module 200 and housing 102. Accordingly, gaskets may both absorb mechanical energy to decouple speaker module 200 from housing 102, and may create an acoustically opaque path for sound 316 propagation. Gaskets may be between both sides of speaker module 200 and walls 104, 106 of housing 102 (not shown).

It will be appreciated that electronic device 100 having a lateral link including a lever 502 and a fulcrum 504 may incorporate any of the speaker orientations or front and back volume configurations described above with respect to FIGS. 3-4. For example, electronic device 100 illustrated in FIG. 5 may include first speaker module 310 having first front volume 323 in fluid communication with enclosure 402 within housing 102. Second speaker module 320 may include second back volume 328, and first front volume 323 and enclosure 402 may have a combined spatial volume equal to a spatial volume occupied by second back volume 328. Similarly, enclosure 402 may be laterally between first front volume 323 and second back volume 328 within housing 102. Furthermore, first speaker module 310 may include first back volume 324 ported through slot 318 in first wall 104 of housing 102, and second speaker module 320 may include second front volume 326 ported through one or more slots 318 in second wall 106 of housing 102. Second wall 106 may be opposite of first wall 104, e.g., second wall 106 may be an upper wall of a laptop computer and first wall 104 may be a lower wall of the laptop computer. In the interest of brevity, it will be appreciated that such speaker and volume configurations of electronic device 100 may also be used in combination with the embodiments described below with respect to FIGS. 6-7. More particularly, those embodiments may incorporate any of the features of the embodiments described above.

Figure 6:
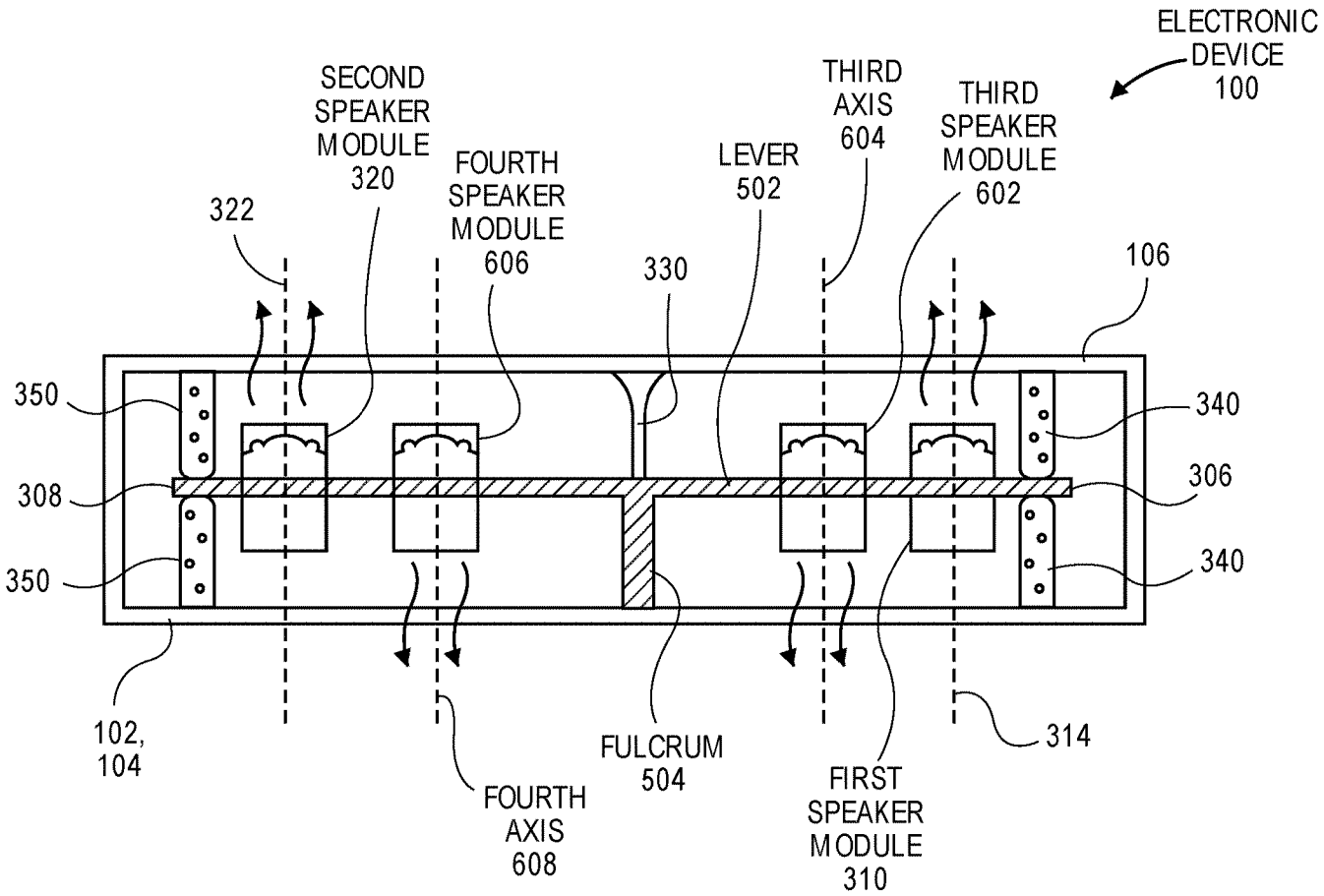
FIG. 6 is a sectional view of an electronic device having pairs of speaker modules on opposite sides of a fulcrum in accordance with an embodiment.

Referring to FIG. 6, a sectional view of an electronic device having pairs of speaker modules on opposite sides of a fulcrum is shown in accordance with an embodiment. As described above, electronic device 100 having speaker modules 200 mounted on a rigidly supported lateral link may reduce a net reactive force transmitted to housing 102. The reactive forces of each speaker module 200 within housing 102, however, may generate reactive moments at the rigid support. For example, with respect to speaker modules 200 mounted on lever 502 rigidly supported by fulcrum 504, a reactive force from a speaker module 200 on a first side of the joint between lever 502 and fulcrum 504 may generate a moment in a first direction (positive or negative) and a reactive force from a speaker module 200 on a second side of the joint may generate a moment in a second direction opposite to the first direction.

In an embodiment, pairs of speaker modules 200 are mounted on lever 502 on each side of the joint between lever 502 and fulcrum 504. For example, as described above, first speaker module 310 may be mounted on lever 502 at first end 306 laterally separated from fulcrum 504. First speaker module 310 may drive sound 316 through second wall 106 of housing 102 in an upward direction. Thus, a parasitic reactive force from first speaker module 310 may be downward, causing a negative moment at the joint between lever 502 and fulcrum 504. To offset this moment, a third speaker module 602 may be mounted on lever 502 at first end 306 adjacent to first speaker module 310. Third speaker module 602 may include a third motor assembly having a respective voicecoil 210 that moves along a third axis 604 in a direction opposite to a respective voicecoil 210 of first speaker module 310 when driven by audio signal 312. More particularly, first speaker module 310 and third speaker module 602 may be acoustically in-phase and mechanically out-of-phase, and thus, the reactive force from third speaker module 602 may generate a positive moment at the joint between lever 502 and fulcrum 504 to counteract the moment generated by first speaker module 310. Accordingly, a sum of the moments generated by first speaker module 310 and third speaker module 602 at the joint may be zero, or nearly zero.

Second speaker module 320 on an opposite side of fulcrum 504 from first speaker module 310 may similarly be paired with a counterpart speaker module 200 to create a zero-sum of moments at the joints between lever 502 and fulcrum 504. More particularly, electronic device 100 may include a fourth speaker module 606 having a respective voicecoil 210 that moves along a fourth axis 608 when driven by audio signal 312. Fourth speaker module 606 may be mounted on lever 502 at second end 308 adjacent to second speaker module 320. Furthermore, second speaker module 320 and fourth speaker module 606 may be acoustically in-phase and mechanically out-of-phase such that the reactive force from second speaker module 320 is in a direction along second axis 322 and the reactive force from fourth speaker module 606 is in an opposite direction along fourth axis 608. The reactive forces from second speaker module 320 and fourth speaker module 606 may generate opposing moments at the joint between lever 502 and fulcrum 504. Accordingly, a sum of the moments generated by second speaker module 320 and fourth speaker module 606 at the joint may be zero, or nearly zero.

Note that speaker modules 320 on opposite sides of the joint between lever 502 and fulcrum 504 may also generate canceling moments. For example, first speaker module 310 and second speaker module 320 may be equidistant from the joint between lever 502 and fulcrum 504. Similarly, third speaker module 602 and fourth speaker module 606 may be equidistant from the joint. Thus, the opposing speaker modules, when moving in the same direction, i.e., when mechanically in-phase, on opposite sides of the joint, may generate opposing moments at the joint. As such, a net moment at the joint of the speaker module assembly having several pairs of speakers mounted at opposite ends of lever 502 may be zero, and thus, parasitic force into the housing 102 may be limited.

Figure 7:
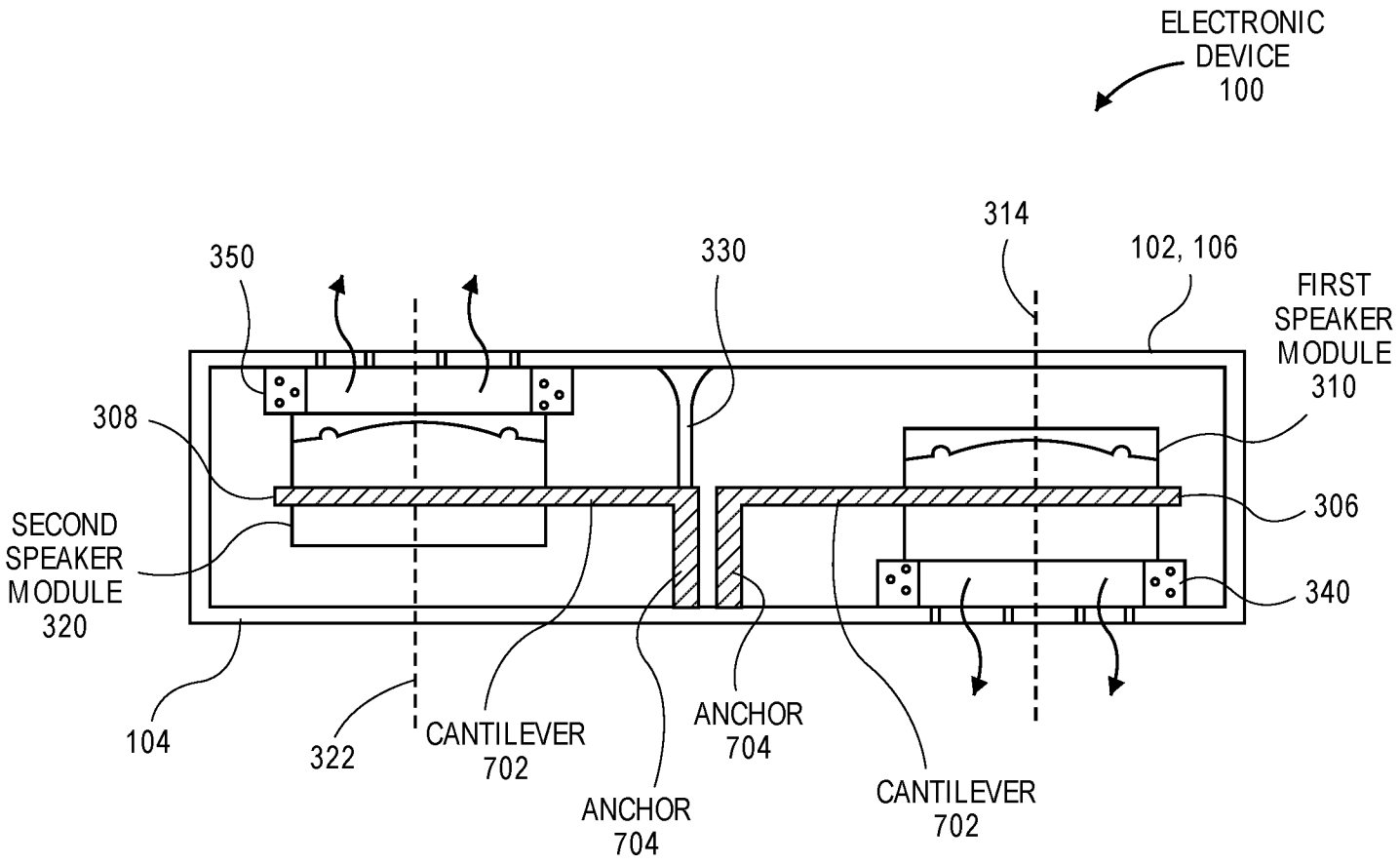
FIG. 7 is a sectional view of an electronic device having speaker modules mounted on cantilevers in accordance with an embodiment.

Referring to FIG. 7, a sectional view of an electronic device having speaker modules mounted on cantilevers is shown in accordance with an embodiment. Electronic device 100 can include a lateral link having one or more speaker modules 200 on only one side of an attachment to housing 102. For example, the lateral link may include an individual driver mounted on a flexible cantilever 702.

In an embodiment, electronic device 100 includes a cantilever 702 extending laterally within housing 102 from an anchor 704 to a first end 306. Anchor 704 may have a structure similar to fulcrum 504 described above. For example, anchor 704 may be a vertical support or stanchion extending from first wall 104 into an internal volume within housing 102. Like fulcrum 504, anchor 704 may be a rigid support, i.e., having a higher stiffness than housing 102. Unlike fulcrum 504, however, anchor 704 may support cantilever 702 rather than lever 502. Cantilever 702 may be flexible and have a stiffness less than the stiffness of housing 102 and/or anchor 704. As such, a load applied to a free end of cantilever 702 may deflect cantilever 702 such that cantilever 702 acts as a spring.

First speaker module 310 may be mounted on cantilever 702 at first end 306. Thus, when driven by audio signal 312, voicecoil 210 of first speaker module 310 may move along first axis 314 in a first direction. Accordingly, sound 316 generated by first speaker module 310 may be directed along first axis 314 and outward through ports in housing 102. The sound generation may be accompanied by a reactive force that is transmitted into cantilever 702. Cantilever 702 may absorb energy from the reactive force and dissipate the energy to reduce parasitic force transmission into housing 102, much as the gaskets described above reduce such parasitic force transmission. Furthermore, electronic device 100 may include gaskets, e.g., first gasket 340, to absorb mechanical energy and to direct sound 316 from the speaker modules 200 within housing 102 outward into the surrounding environment.

Electronic device 100 may include several cantilevers 702 extending laterally within housing 102 from respective anchors 704. For example, a second cantilever 702 may extend laterally from a second anchor 704 in an opposite direction of the first cantilever 702. Second speaker module 320 may be mounted on the second cantilever 702. For example, second speaker module 320 may be mounted at second end 308 of the second cantilever 702. When driven by audio signal 312, a respective voicecoil 210 of second speaker module 320 may move along second axis 322. First speaker module 310 and second speaker module 320 may be acoustically in-phase and mechanically out-of-phase such that audio signal 312 drives their voicecoils 210 in opposite directions. Thus, when first speaker module 310 radiates sound 316 through first wall 104 of housing 102, second speaker module 320 may radiate sound 316 through second wall 106 of housing 102. A parasitic reactive force from second speaker module 320 may be transmitted into second cantilever 702, and second cantilever 702 may absorb and dissipate energy from the reactive force. Thus, in addition to having offset reactive forces to reduce a net parasitic force, energy may be dissipated within cantilevers 702 rather than being transmitted into housing 102. Accordingly, the rub and buzz problem may be mitigated.

Experiments have proven that the above-described embodiments reduce force transmission into housing 102. For example, the embodiment described with respect to FIG. 3 reduced force transmission into housing 102 by about 6 dB as compared to a typical in-phase speaker pair. Similarly, the embodiment described with respect to FIG. 5 reduced force transmission into housing 102 by an additional 5-10 dB. Accordingly, it has been shown that a rigidly supported lateral link between laterally offset speaker modules driven acoustically in-phase and mechanically out-of-phase may reduce parasitic force transmission into a housing to reduce rub and buzz.

Figure 8:
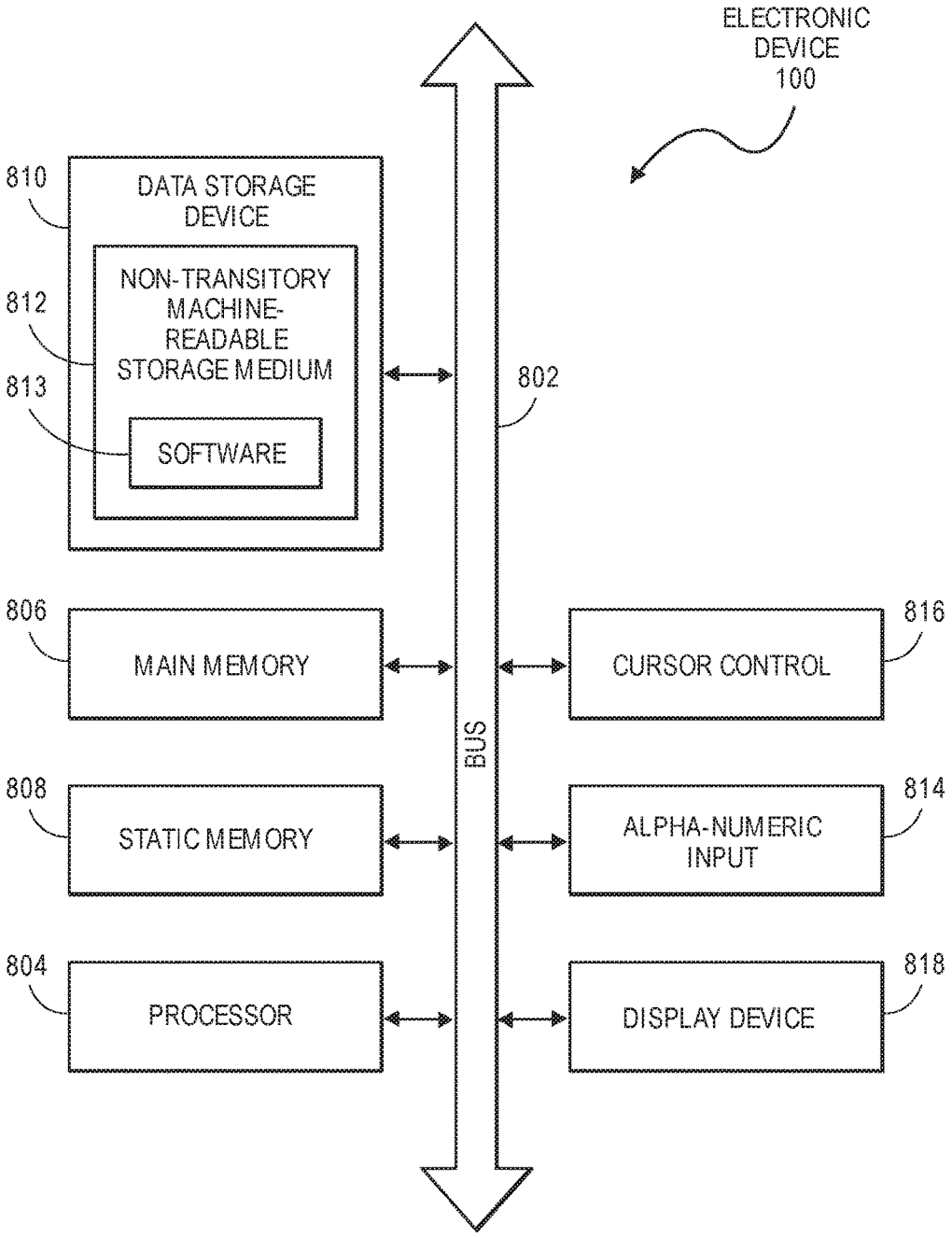
FIG. 8 is a schematic view of an electronic device in accordance with an embodiment.

Referring to FIG. 8, a schematic view of an electronic device is shown in accordance with an embodiment. Electronic device 100 may have a processing system that includes the illustrated system architecture. Certain standard and well-known components which are not germane to the present invention are not shown.

Processing system may include an address/data bus 802 for communicating information, and one or more processors 804 coupled to bus 802 for processing information and instructions. Processing system may also include data storage features such as main memory 806 having computer usable volatile memory, e.g., random access memory (RAM), coupled to bus 802 for storing information and instructions for processor(s) 804, static memory 808 having computer usable non-volatile memory, e.g., read only memory (ROM), coupled to bus 802 for storing static information and instructions for the processor(s) 804, and a data storage device 810 (e.g., a magnetic or optical disk and disk drive) coupled to bus 802 for storing information and instructions.

Data storage device 810 may include a non-transitory machine-readable storage medium 812 storing one or more sets of instructions (e.g., software 813). Software 813 may include software applications, for example. Software 813 may also reside, completely or at least partially, within main memory 806, static memory 808, and/or within processor(s) 804 during execution thereof by processing system. More particularly, main memory 806, static memory 808, and processor(s) 804 may also constitute non-transitory machine-readable storage media.

Processing system of the present embodiment also includes input devices for receiving active or passive input. For example, an alphanumeric input device 814 may include alphanumeric and function keys coupled to bus 802 for communicating information and command selections to processor(s) 804. Alphanumeric input device 814 may include input devices of various types, including keyboard devices, touchscreen devices, or voice activation input devices, to name a few types. Processing system may also include a cursor control 816 device, e.g., a mouse device, coupled to bus 802 for communicating user input information and command selections to processor(s) 804. Such devices may be manual input device 110 as described above. Processing system may include a display device 818, such as display 108 described above, which may be coupled to bus 802 for displaying information to an operator.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An electronic device, comprising:

a housing having a first wall and a second wall opposite of the first wall, the housing including a display and a manual input device;

a rigid connector extending in a lateral direction between a first end and a second end within the housing;

a first speaker module mounted on the rigid connector at the first end, the first speaker module including a first voicecoil, wherein the first voicecoil moves along a first axis in a first direction orthogonal to the lateral direction when driven by an audio signal to radiate sound through the first wall;

a second speaker module mounted on the rigid connector at the second end, the second speaker module including a second voicecoil, wherein the second voicecoil moves along a second axis in a second direction opposite to the first direction when driven by the audio signal to radiate sound through the second wall; and a partition extending between the first wall and the second wall, wherein the partition includes a fulcrum between the housing and the rigid connector, and wherein the first axis and the second axis are laterally offset from each other on opposite sides of the fulcrum.

2. The electronic device of claim 1, wherein the audio signal includes an electrical current, wherein the electrical current travels through the first voicecoil about the first axis in the first direction, and wherein the electrical current flows through the second voicecoil about the second axis in the second direction.

3. The electronic device of claim 1, wherein the first speaker module includes a first front volume in fluid communication with an enclosure within the housing, wherein the second speaker module includes a second back volume, and wherein the first front volume and the enclosure have a combined spatial volume equal to the second back volume.

4. The electronic device of claim 3, wherein the enclosure is laterally between the first front volume and the second back volume within the housing.

5. The electronic device of claim 4, wherein the first speaker module includes a first back volume ported through a first slot in the first wall of the housing, and wherein the second speaker module includes a second front volume ported through a second slot in the second wall of the housing.

6. A electronic device, comprising:

a housing including a display and a manual input device;

a lever extending laterally between a first end and a second end within the housing;

a first speaker module mounted on the lever, the first speaker module including a first voicecoil, wherein the first voicecoil moves along a first axis in a first direction when driven by an audio signal;

a second speaker module mounted on the lever, the second speaker module including a second voicecoil, wherein the second voicecoil moves along a second axis in a second direction opposite to the first direction when driven by the audio signal; and a fulcrum between the housing and the lever, wherein the fulcrum is coupled to the lever between the first axis and the second axis.

7. The electronic device of claim 6, wherein the first speaker module is mounted on the lever at the first end and the second speaker module is mounted on the lever at the second end such that the first axis and the second axis are laterally offset from each other on opposite sides of the fulcrum.

8. The electronic device of claim 7 further comprising:

a first gasket between the housing and the first speaker module; and a second gasket between the housing and the second speaker module, wherein the gaskets provide acoustically opaque paths to direct sound from respective speaker modules to a surrounding environment.

9. The electronic device of claim 8, wherein the first gasket and the second gasket are less stiff than the lever.

10. The electronic device of claim 6, wherein the fulcrum is coupled to the lever by a pin joint.

11. The electronic device of claim 6, wherein the first speaker module includes a first front volume in fluid communication with an enclosure within the housing, wherein the second speaker module includes a second back volume, and wherein the first front volume and the enclosure have a combined spatial volume equal to the second back volume.

12. The electronic device of claim 11, wherein the enclosure is laterally between the first front volume and the second back volume within the housing.

13. The electronic device of claim 12, wherein the first speaker module includes a first back volume ported through a first slot in a first wall of the housing, and wherein the second speaker module includes a second front volume ported through a second slot in a second wall of the housing opposite of the first wall.

14. The electronic device of claim 6 further comprising:

a third speaker module mounted on the lever at the first end adjacent to the first speaker module, wherein the third speaker module includes a third voicecoil, and wherein the third voicecoil moves along a third axis in the second direction when driven by the audio signal; and a fourth speaker module mounted on the lever at the second end adjacent to the second speaker module, wherein the fourth speaker module includes a fourth voicecoil, and wherein the fourth voicecoil moves along a fourth axis in the first direction when driven by the audio signal.

* * * * *